US006250347B1

(12) United States Patent
Tatsuno

(10) Patent No.: US 6,250,347 B1
(45) Date of Patent: Jun. 26, 2001

(54) AUTOMATIC FUELING SYSTEM

(75) Inventor: Hiyoshi Tatsuno, Tokyo (JP)

(73) Assignee: Tatsuno Corporation, Tokyo (JP)

( * ) Notice: Subject to any disclaimer, the term of this patent is extended or adjusted under 35 U.S.C. 154(b) by 0 days.

(21) Appl. No.: 09/515,397

(22) Filed: Feb. 29, 2000

(30) Foreign Application Priority Data

Nov. 18, 1999 (JP) ..... 11-328535

(51) Int. Cl.[7] ..... B65B 1/30; B65B 3/28; B65B 57/06; B65B 57/14; B67C 3/00

(52) U.S. Cl. ..... 141/198; 141/59; 141/83; 141/94; 141/95; 141/99; 141/104; 141/192; 141/250; 141/285; 141/302; 141/392; 340/450.2; 340/941

(58) Field of Search ..... 141/83, 94–96, 141/98–100, 104, 105, 59, 192, 198, 231, 232, 250, 266, 279, 285, 301, 302, 308, 311 R, 392; 340/450.2, 941, 988; 137/234.6

(56) References Cited

U.S. PATENT DOCUMENTS 3,642,036 * 2/1972 Ginsburgh et al. ..... 141/84
5,309,957 * 5/1994 Saisuu ..... 141/83
5,628,351 * 5/1997 Ramsey, Jr. et al. ..... 141/98
5,634,503 * 6/1997 Musil et al. ..... 141/232
6,068,030 * 5/2000 Tatsuno ..... 141/94

* cited by examiner

*Primary Examiner*—Timothy L. Maust
(74) *Attorney, Agent, or Firm*—Birch, Stewart, Kolasch & Birch, LLP

(57) ABSTRACT

An automatic fueling system containing a fueling machine having a nozzle mechanism comprising an injection pipe with a nozzle insertion sensor thereon, and a plurality of fueling nozzles contained in the injection pipe, each for dispensing a predetermined sort of fuel, and a fuel port sensor; and a data input/output unit for performing a signal transmission to and from the fueling machine; wherein the insertion of one of the nozzles is carried out to an automobile to be fueled having a signal generator thereon by the movement of the fueling machine based on the signal transmission between the fuel port sensor and the signal generator, and the fueling is suspended by the detection of a required level of fueling.

6 Claims, 9 Drawing Sheets

AUTOMATIC FUELING SYSTEM

BACKGROUND OF THE INVENTION

1. Field of the Invention

The present invention relates to an automatic fueling system, and more specifically to an automatic fueling system by which all the steps of the fueling operation including the insertion of a fueling nozzle to a fueling port of an automobile, the fuel-sort discrimination and the suspension of fueling at a required fueling level are carried out without a manual operation of fueling nozzles.

2. Discussion of Related Art

In a recent gas station, many efforts have been made to reduce the cost for fueling, for instance by producing a semi-automatic fueling system, thereby eliminating the number of fueling operators.

For example, there has been disclosed as Kokoku Publication 2 (1990)-12840 a fueling system wherein a fueling nozzle is automatically inserted to a fueling port of an automobile to be fueled. Furthermore, fueling systems are reported which have fuel-sort discrimination units for preventing from dispensing different sorts of fuel from the ones in fuel tanks in cars as disclosed in Japanese Kokai Publications 6 (1994)-115598 and 8 (1996)-169498, fueling systems which automatically dispense fuel to automobiles to the full-tank level thereof by the provision of full-tank fueling units as disclosed in Japanese Kokai Publications 58 (1983)-41095 and 63 (1988)-125196.

All of the above-mentioned fueling systems are effectively used with a minimum number of fueling operators, although there is no fueling system reported which is completely automatic and with which the fueling operation is safely carried out only by a customer with inputting some signal to the fueling system.

SUMMARY OF THE INVENTION

It is therefore an object of the present invention to provide a fueling system of which fueling steps are performed automatically only by the signal input by a customer.

The object of the present invention is achieved by an automatic fueling system comprising a fueling machine comprising a nozzle mechanism comprising an injection pipe having a nozzle insertion sensor thereon, and a plurality of fueling nozzles contained in the injection pipe, each for dispensing a predetermined sort of fuel, and a fuel port sensor; and a data input/output unit for performing a signal transmission to and from the fueling machine; wherein the insertion of one of the nozzles is carried out to an automobile to be fueled having a signal generator thereon by the movement of the fueling machine based on the signal transmission between the fuel port sensor and the signal generator, and the fueling is suspended by the detection of a required level of fueling.

The object of the present invention is also achieved by an automatic fueling system comprising a first fueling machine and a second fueling machine, each comprising a fuel control unit comprising a fuel-sort discrimination unit, a full-tank fueling unit, an injection pipe having a nozzle-insertion sensor thereon, and a plurality of fueling nozzles contained in the injection pipe, each for dispensing a predetermined sort of fuel, and a fuel port sensor; and a first data input/output unit and a second data input/output unit for performing a signal transmission respectively to and from the first fueling machine and the second fueling machine; wherein the first fueling machines performs the insertion of one of the nozzles thereof to an automobile to be fueled having a signal generator thereon by the movement of the fueling machine based on the signal transmission between the fuel port sensor and the signal generator, the fuel control unit causes to function the fuel sort discrimination unit by the receipt of a nozzle-insertion signal from the nozzle-insertion sensor, and causes to function the full-tank fueling unit to start fueling when the fuel sort discrimination unit detects a correct fuel selection, the fueling is suspended by the detection of a required level of fueling by the full-tank fueling unit, and the first data input/output unit inhibits an input from the second data input/output unit by outputting a data input/output inhibition signal to the second data input/output unit when a fueling data is input to the first data input/output unit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
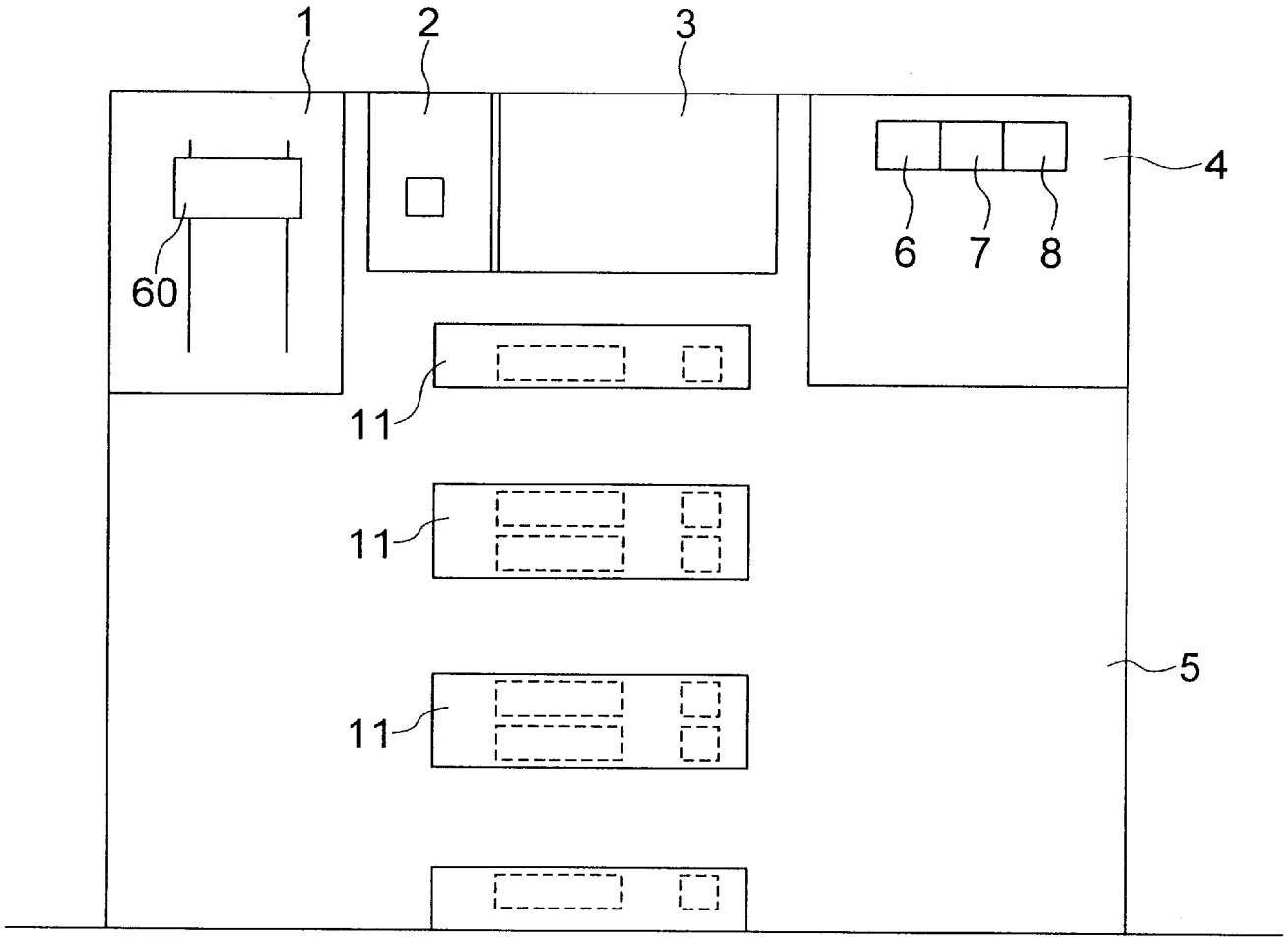
FIG. 1 is a schematic plane diagram of a gas station wherein an automatic fueling system of the present invention can be provided.

The automatic fueling system according to the present invention comprises a fueling machine comprising a nozzle mechanism comprising an injection pipe having a nozzle insertion sensor thereon, and a plurality of fueling nozzles contained in the injection pipe, each for dispensing a predetermined sort of fuel, and a fuel port sensor; and a data input/output unit for performing a signal transmission to and from the fueling machine. It is preferable that the fueling machine for use in the present invention comprises a fuel control unit comprising a fuel-sort discrimination unit and a full-tank fueling unit. By the automatic fueling system of the present invention, all the steps of the fueling operation are automatically carried out only by a simple data input by a customer in a safe way.

More specifically, when the fuel port sensor provided in the fueling machine detects the signal obtained from the customer's signal generator, the fueling machine automatically changes its position as to be appropriate for fueling, and a nozzle for a required fuel sort is automatically extended into the fueling port of the car. Thereafter, a nozzle-insertion signal is given from the nozzle-insertion sensor to the fuel control unit, thereby starting to function the fuel sort discrimination unit. If the fuel sort discrimination unit detects a correct fuel selection by comparing the fuel sort remained in the fueling port of the car with the selected sort of fuel to be dispensed, the full-tank fueling unit starts fueling. At the state where fueling is performed to the full-tank level, fueling is suspended with the detection of the level by the full-tank fueling unit.

The automatic fueling system of the present invention is often composed of a plurality of fueling machines, and the plurality of data input/output units each of which performs the transmission of the fueling signals as mentioned above to and from each of the fueling machines.

In the case where a first fueling machine and a second fueling machine are provided to face each other with such a distance that only a single car passes between the first fueling machine and the second fueling machine, it is necessary to make only the first fueling machine function which is on the fueling port side of a car to be fueled, without causing accidental fuel dispensing from the second fueling machine on the other side of the car.

In the fueling system of the present invention, it is possible to inhibit an input from the second data input/output unit, by a first data input/output unit corresponding to the first fueling system outputting a data input/output inhibition signal to a second data input/output unit corresponding to the second fueling machine when a fueling data is input to the first data input/output unit.

Moreover, it is possible in the fueling system of the invention that the first fueling machine transmits a fueling inhibition signal to the second fueling machine by way of the first and second data input/output units when the first fueling machine detects the signal generator, whereby an undesired fuel discharge can be prevented.

Other features of this invention will become apparent in the course of the following description of exemplary embodiments, which are given for illustration of the invention and are not intended to be limiting thereof.

FIG. 1 shows a gas station seen from the top for showing a general arrangement thereof wherein a car washing area 1, an office 2, and a convenience store 3, a maintenance unit 4, and a fueling area 5 are there. There is a car washing machine 60 in the car washing area 1. Furthermore, there are provided a maintenance unit 6, cleaning unit 7 and garbage container 8 in the maintenance area 4, and islands 11 with such a distance between the adjacent ones where a car passes therethrough.

Figure 2:
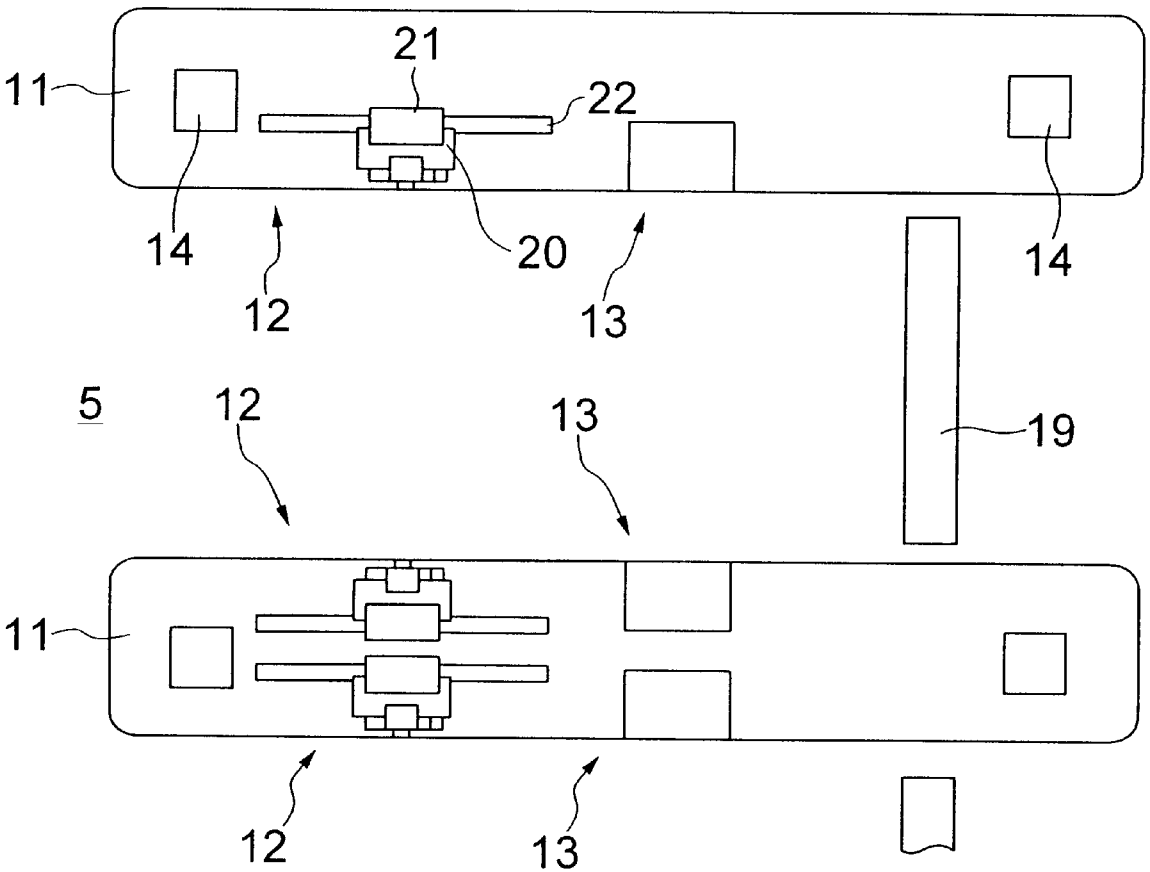
FIG. 2 is a schematic plane diagram for showing an automatic fueling system of the present invention.
Figure 3:
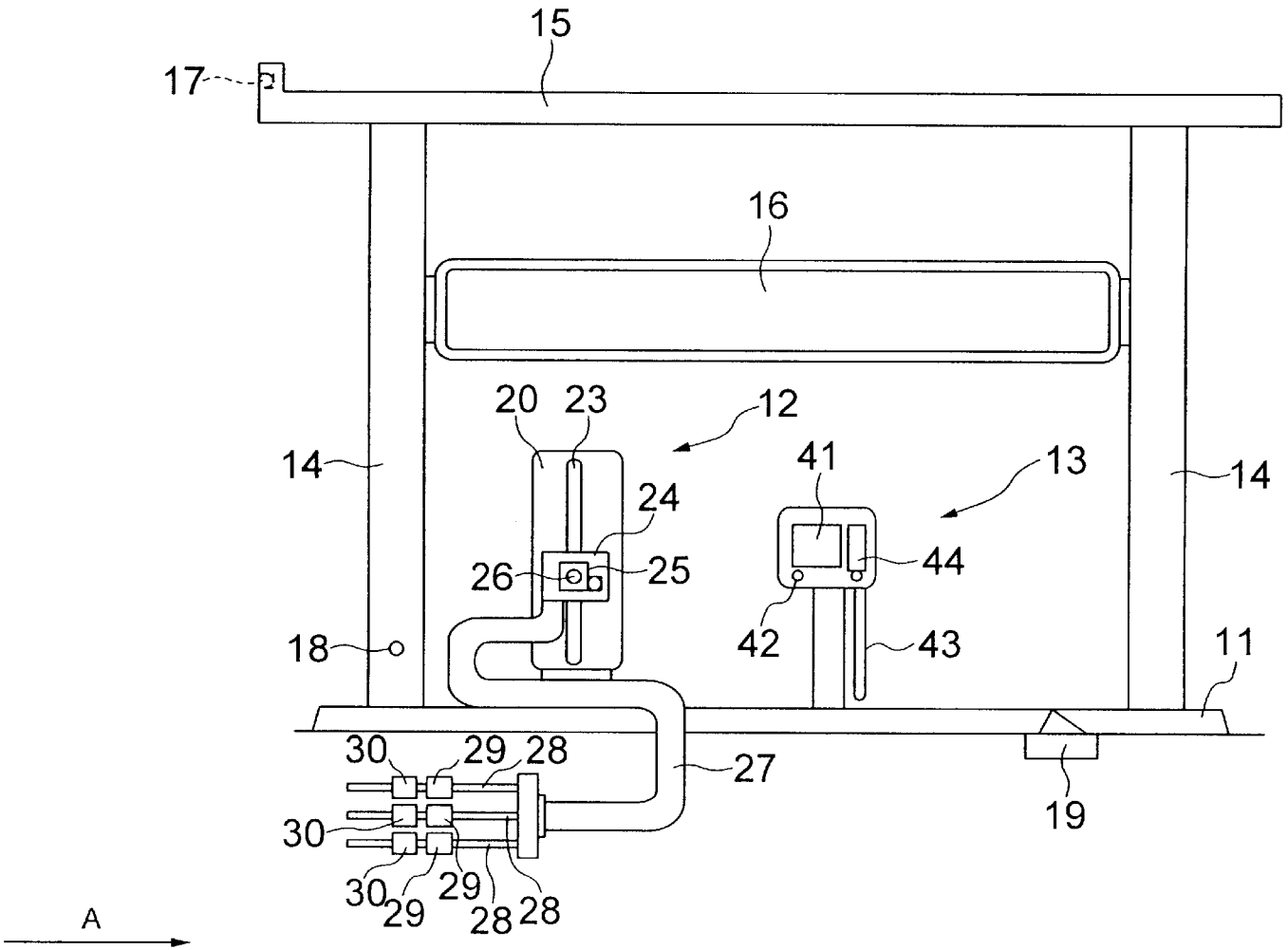
FIG. 3 is a front elevation for showing an automatic fueling system of the present invention.

As shown in the plane elevation of FIG. 2 and the front elevation of FIG. 3, each of the islands 11 has one or more fueling units 12, and one or more data input/output unit 13 thereon in the fueling area 5, each for performing signal transmission with a corresponding data input/output unit. Namely, the fueling system of the present invention comprises pairs of the fueling unit 12 and the data input/output unit 13.

In FIG. 3, a pair of posts 14 is provided on one of the islands 11, and a canopy 15 is attached to the posts 14 on the top thereon, and a spreader 16 is provided therebetween as shown in FIG. 3. An entrance judge lamp 17 is provided at one end of the canopy 15. An automobile comes into the passage beside the fueling system in the direction of an arrow A, so that a driver of a car can recognize if it is possible to come into the fueling area beside the fueling unit by the notification of the entrance judge lamp 17. There is also provided an entry sensor 18 on the front post 14. Car stoppers 19 are formed on the car passages between islands 11.

The function of the fueling unit 12 for use in the present invention will now be explained in detail with further referring to FIGS. 2 and 3. The fueling unit 12 is covered with a housing 20, which horizontally moves along a horizontal rail 22 formed on the island 11 by means of a horizontal moving unit 21 (FIG. 2). Moreover, the housing 20 has a vertical rail 23 (FIG. 3), along which a vertical moving unit 24 moves to change the height of a nozzle mechanism 25 formed onto the vertical moving unit 24. A plurality of fueling nozzles, for instance three nozzles 26 are contained in the nozzle mechanism 25, and the fueling nozzles 26 are respectively connected to fuel storage tanks (not shown) by way of hoses 27, and pipes 28. Flow meters 29 and pumps 30 are provided to the pipes 28. Premium, regular and diesel are respectively stored in the fuel storage tanks and dispensed from the corresponding fueling nozzles 26.

Figure 4:
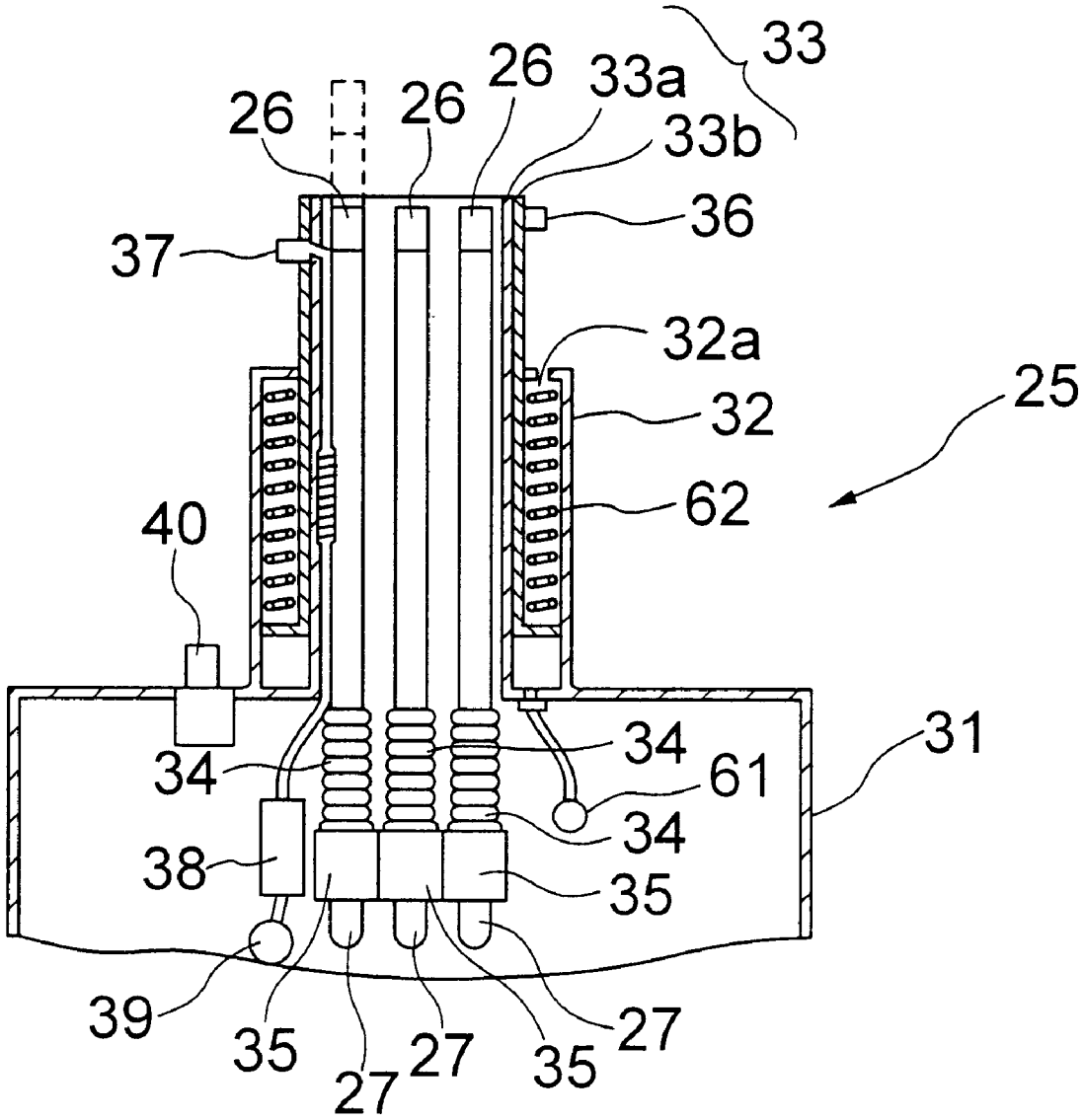
FIG. 4 is a horizontal cross-section of a nozzle mechanism employed for the automatic fueling system of the present invention.

FIG. 4 shows a horizontal cross-section of a nozzle mechanism 25 for use in the present invention. A nozzle mechanism main body 31 is set on the vertical moving unit shown in FIG. 3 and contains an extending-shortening unit 32 with a hole 32*a* on the front surface thereof. An injection pipe 33 is formed, in this figure, as a two layered pipe having an inner pipe 33*a* and an outer pipe 33*b* which slide each other, and is extended and shortened by the aid of the extending-shortening unit 32. The injection pipe 33 is provided with the fueling nozzles 26 therein.

More precisely, it is preferable that the nozzle mechanism main body 31, the extending-shortening unit 32 and the inner pipe 33*a* be formed as a united body so as to be engaged with the outer pipe 33*b* as shown in FIG. 4. The flange of the outer pipe 33*b* is pressed up by compressed air supplied from an air source 61, so that the injection pipe 33 is protruded into a fuel port of a car. When the air supply from the air source 61 is stopped, the outer pipe 33*b* is brought back to the initial position by the force of springs 62 provided in the extending-shortening unit 32, thereby withdrawing the outer pipe 33*b*.

The fueling nozzles 26 are connected to fueling hoses 27 via bellow-tubes 34 and opening-closing valves 35. When a fuel sort is selected and the corresponding valve 35 is driven, a desired fueling nozzle 26 is extended as shown by the broken line in FIG. 4 by the pressure applied by the fuel running in the nozzle 26. A nozzle-insertion sensor 36 and a vapor-absorption port 37 are provided on the outer pipe 33*b* of the injection pipe 33 near the tip thereof, and the vapor absorption port 37 and a suction pump 39 are connected by a tube via a fuel sort sensor 38.

Moreover, the nozzle mechanism main body 31 has a fuel port sensor 40 thereon. In this nozzle mechanism 25 used in the automatic fueling system of the present invention, different sorts of fuel are never mixed since each sort of fuel passes through an independent way from the fuel storage tank to the nozzle 26.

Referring back to FIG. 3, the data input/output unit 13 has a display 41, a communicator 42, and a mobile data input part 44 connected to the data input/output unit 13 by way of a signal line 43. The mobile data input part 44 can be prepared as a wireless form to effectively perform the fuel data input, for instance, while sitting inside the car.

Figure 5:
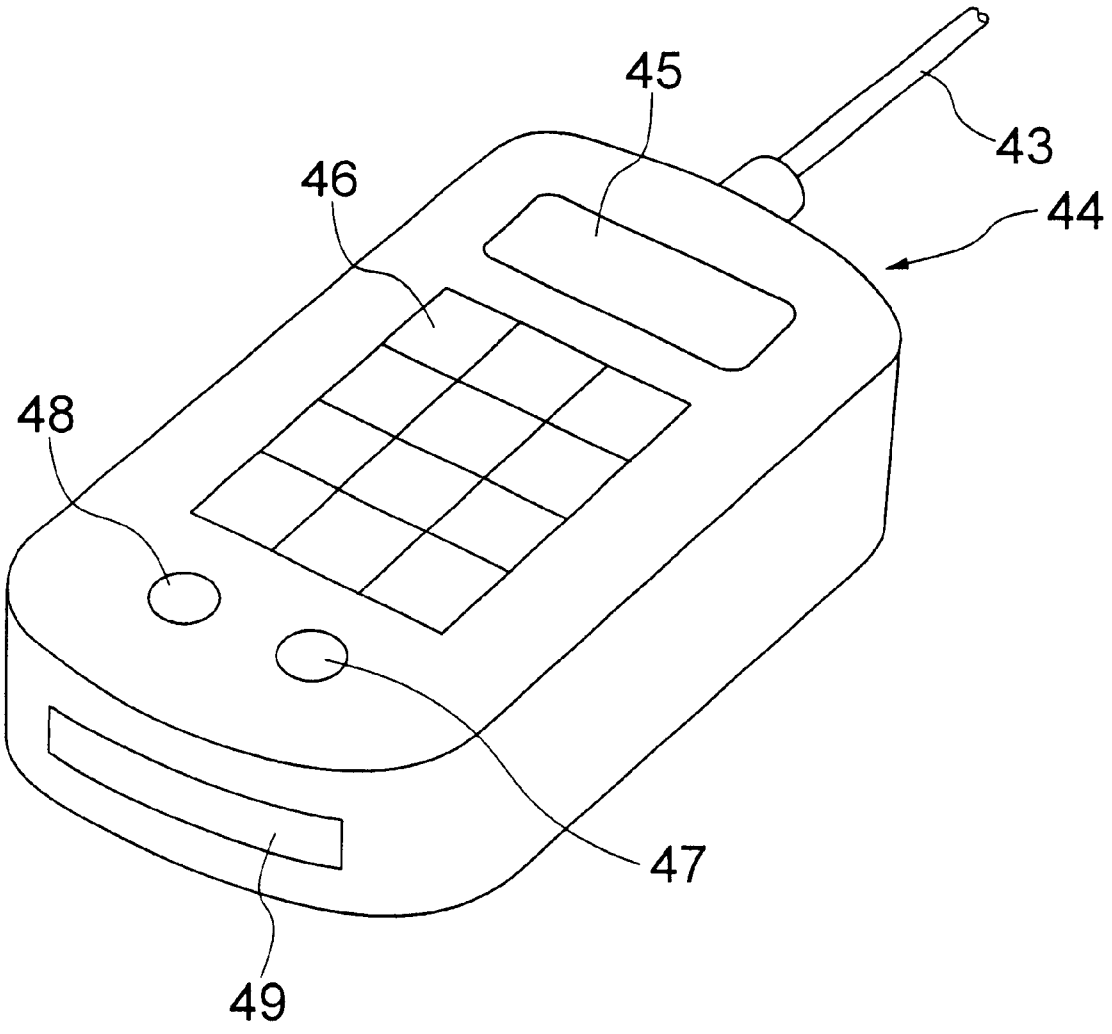
FIG. 5 is a perspective diagram of a mobile data input part provided on a data input/output unit used for the present invention.

FIG. 5 shows a perspective view of the mobile data input part 44 with a display part 45, a keyboard 46, a fixation button 47, a confirmation button 48, and a card-reading-writing device 49. The card-reading-writing device 49 is a part where a credit card, a banking card, a fueling card, a pre-paid card, an IC card or the like is read or written. In this figure, a signal line 43 connects the mobile data input part 44 to the data input/output unit. The fueling data input by means of the keyboard 46 on the mobile data input part 44 is shown both the display 41 of the data input/output unit 13 and the display part 45, the display part 45 showing not all the information shown on the display 41, but only essential information.

Figure 6:
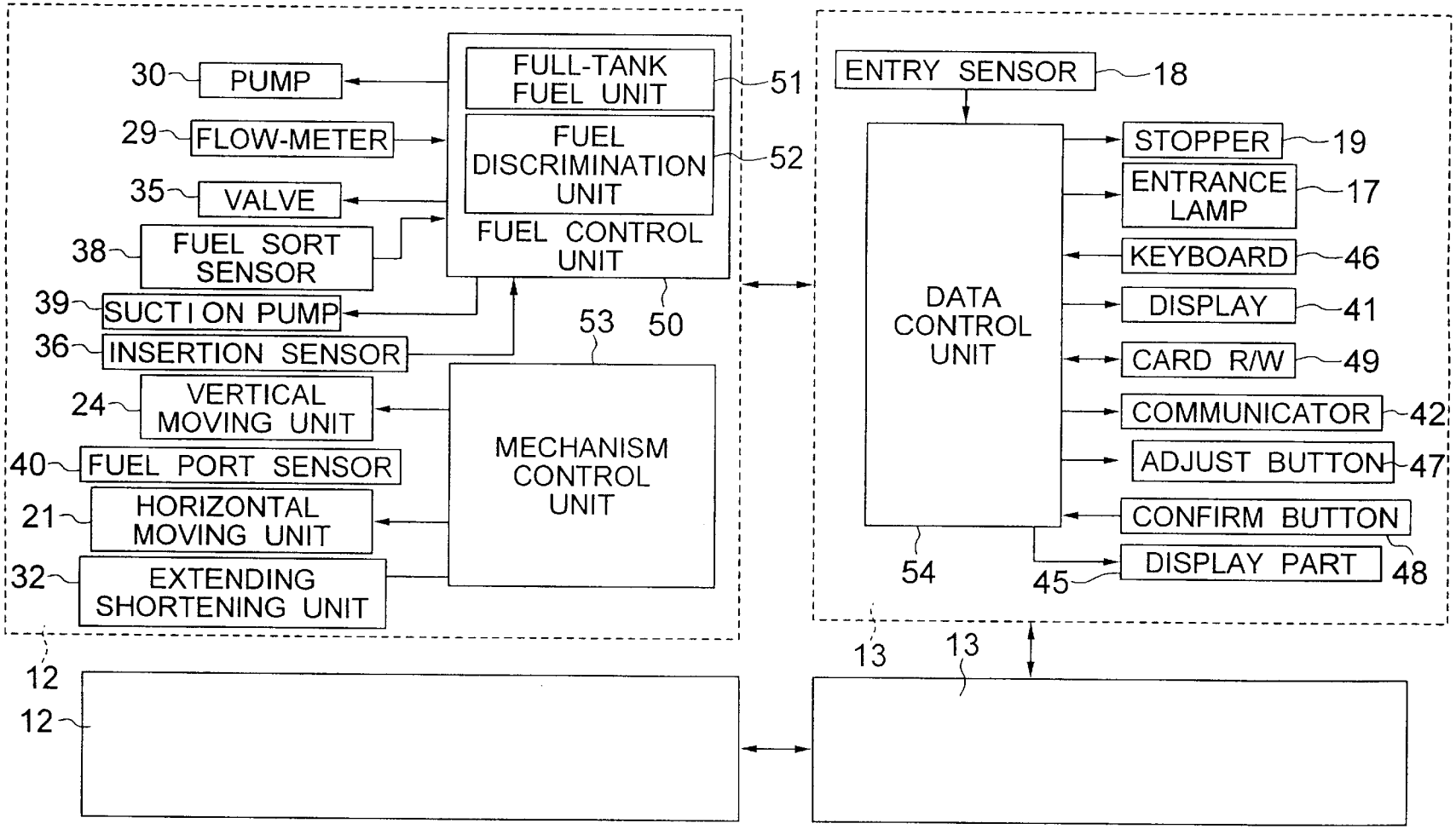
FIG. 6 is a block diagram for explaining the construction of the automatic fueling system of the present invention.

In the fueling machine as shown in the block diagram of FIG. 6, the pumps 30, the flow meters 29, the opening-closing valves 35, the fuel sort sensor 38, the suction pumps 39 and the insertion sensor 36 are connected to the fuel control unit 50 containing the full-tank fueling unit 51 and the fuel sort discrimination unit 52. Moreover, the vertical moving unit 24, the fuel port sensor 40, the horizontal moving unit 21 and the extending-shortening unit 32 are connected to a mechanism control unit 53. The data input/output unit 13 contains a data control unit 54 to which an entry sensor 18, a car stopper 19, an entrance judge lamp 17, a keyboard 46, a display 41, a card-reading-writing device 49, a communicator 42, an fixation button 47, a confirmation button 48, and a display part 45 are connected. The data transmission is performed between the data input/output units 13, hence between the fueling machines 12 by way of the data input/output units 13.

Figure 7:
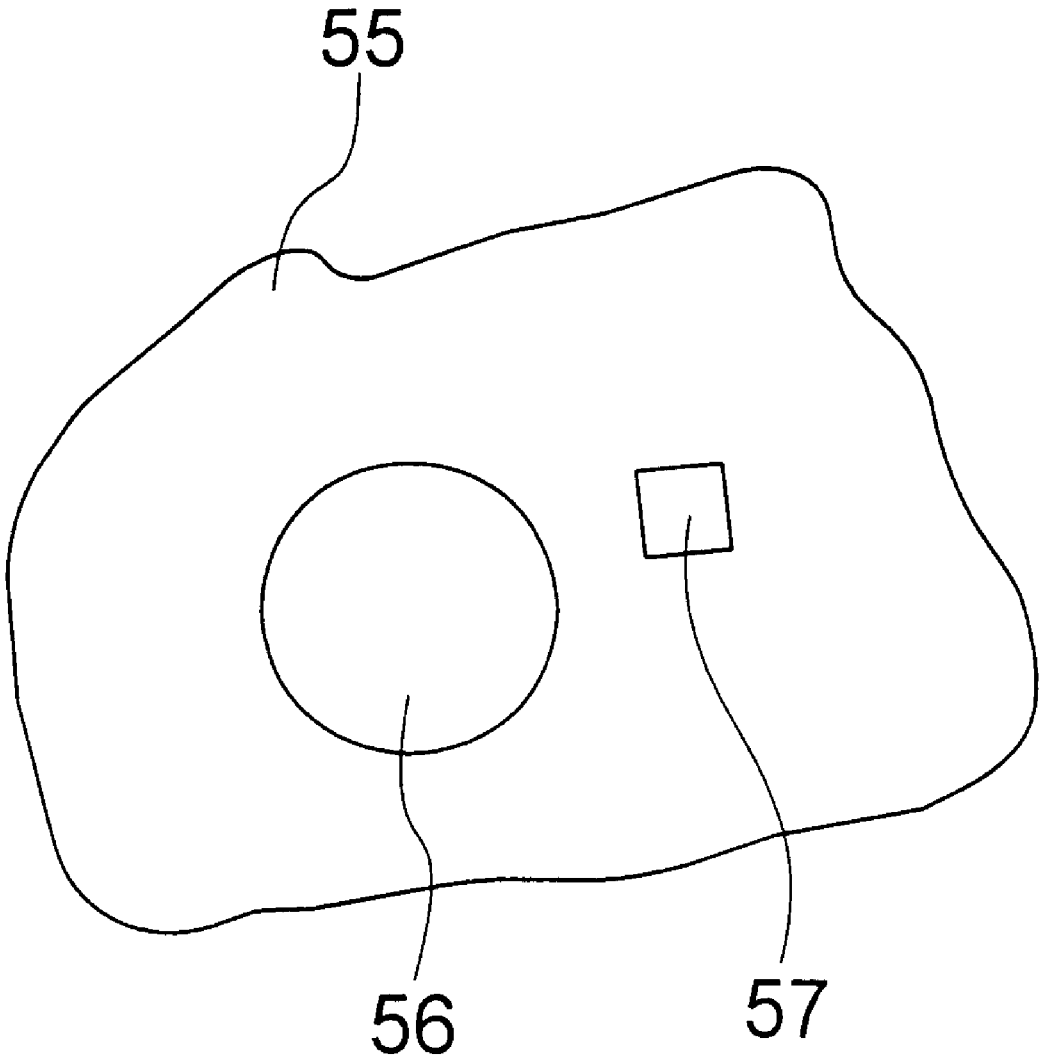
FIG. 7 is a diagram for roughly showing the position of a signal generator to be set on an automobile with respect to a fuel port thereof.

FIG. 7 shows a diagram for showing a part of an automobile 55 to be fueled by the automatic fueling system of the present invention. In the figure, there is provided a signal generator 57 nearby the fuel port 56. The signal generator 57, which preferably is a transponder, outputs a signal, and the fuel port sensor 40 senses the signal therefrom.

The function of the fueling system of the present invention will further be described in detail.

Figure 8:
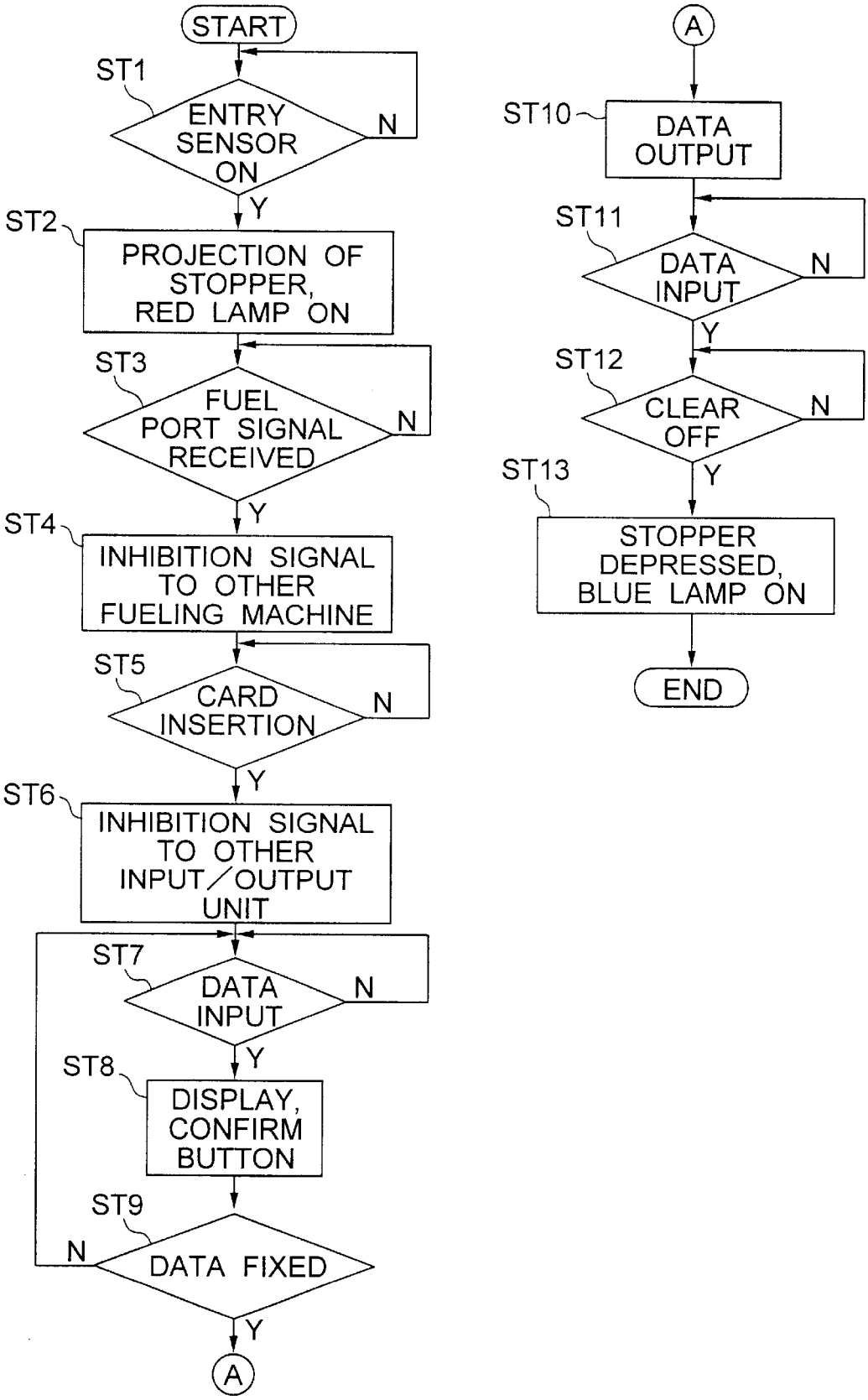
FIG. 8 is a flow chart for explaining the operation of the data input/output unit for use in the automatic fueling system of the present invention.

The operation of the data input/output unit 13 for use in the present invention is illustrated in a flow-chart of FIG. 8.

When there is no car to be fueled, the car stopper 19 is depressed and the entrance judge lamp 17 is being turned on in blue (FIG. 2), while when a car enters the fueling area, an entry sensor 18 transmits a car detection signal to the data control unit 54 (FIG. 8, ST 1). Then, the data control unit 54 causes the car stopper 19 to project in order to prevent the car from leaving the gas station while being fueled simultaneously with turning on the entrance judge lamp 17 in red (FIG. 8, ST2). Subsequently, if a fuel port sensor 40 receives a fuel port signal from the signal generator 57 provided nearby the fuel port 56 of the car (FIG. 8, ST3), the data input/output unit 53 outputs a fueling inhibition signal to a fueling machine which should not work. In the case where there are two fueling machines 13, first and a second fueling machines, which respectively face the left and right sides of a car to be fueled, it is necessary to cause only the first fueling machine 13 facing to the fueling port side of the car to work.

In such a case, the data control unit 54 in the data input/output unit 13 for the first fueling machine, which is ready for fueling, outputs a fueling inhibition signal to the second fueling machine 13 which is located on the side without the fueling port 56 of the car (FIG. 8, ST4) by way of the data input/output unit 13 corresponding to the second fueling machine, thereby preventing the danger of the accidental fuel dispense from the fueling machine at the side of the car without the fueling port 56.

A customer's card is inserted to the card-reading-writing device 49 provided on a mobile data input part 44 of the data input/output unit 13 (FIG. 8, ST5), and then the data control unit 54 outputs a data input/output inhibition signal to the other data input/output unit (FIG. 8, ST6). Accordingly, it becomes possible not to cause an undesired operation of a fueling machine.

The fueling data such as the kind and quantity of fuel to be dispensed is input by means of the keyboard 46 provided on the mobile data input part 44 (FIG. 8, ST7), and the fueling data is displayed on the display 41 and the display part 45. With the confirmation of the displayed data, the confirmation button 48 is pressed (FIG. 8, ST8), and then the fixation button 47 is pressed (FIG. 8, ST9). In this state, the data input/output unit 13 waits the completion of fueling. Accordingly, the data control unit 54 outputs the fueling data, which has been input, to the fueling machine 12 (FIG. 8, ST10).

Figure 9:
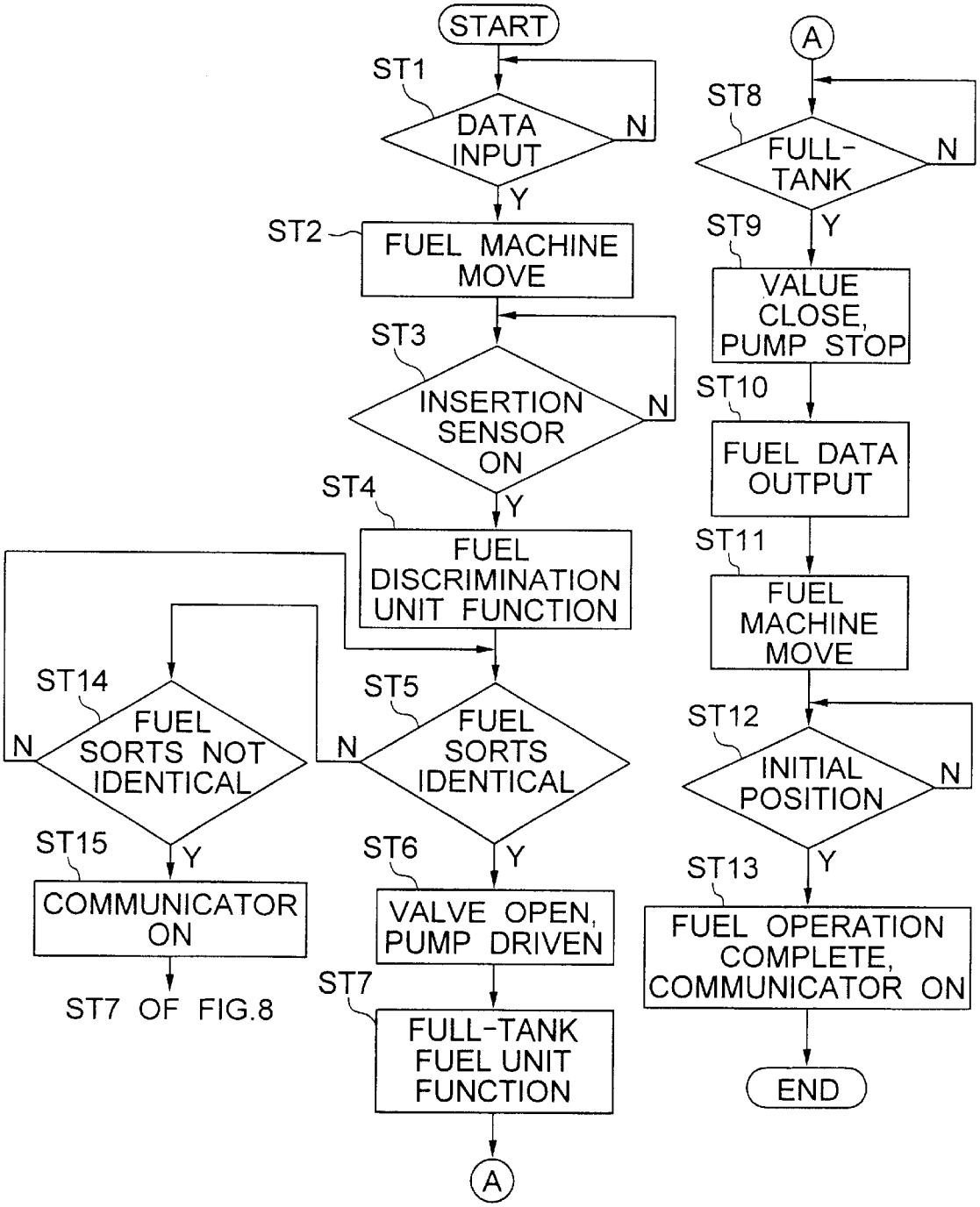
FIG. 9 is a flow chart for explaining the operation of the fueling system of the present invention.

Here, the fueling operation by means of the fueling machine 12 is to be explained with referring to FIG. 9.

The fueling data is transmitted from the data control unit 54 of the data input/output unit 13 to the mechanism control unit 53 of the fueling machine 22 (FIG. 9, ST1). The nozzle mechanism 25 which belongs to the fueling machine 12 is caused to change the position appropriately for fueling, with the horizontal moving unit 21 and the vertical moving unit 24 being driven by the signal from the signal generator 57, whereby the nozzle mechanism 25 is brought to a position nearby the fueling port 56 of a car 55. In this state, the injection pipe 33 is extended by the aid of the extending-shortening unit 32, inserted to the fueling port 56 of the car (FIG. 9, ST2). An insertion signal is input from the insertion sensor 36 (FIG. 9, ST3), and the suction pump 39 is driven to suck the vapor in the fueling port 56, whereby the identity of fuel sorts are judged by the fuel sort discrimination unit 52, which judges whether or not the fuel sort which is sensed by the sensor 38 is identical with the one input by the keyboard 46 (FIG. 9, ST4). When the fuel sorts are judged to be identical from each other (FIG. 9, ST5), the fuel control unit 50 causes the closing-opening valve 35 of a selected fuel sort to be open and to drive the corresponding pump 30 (FIG. 9, ST6).

The required sort of fuel in the fuel storage tank is transported by the application of pressure by the pump, and discharged into the fueling port 56 by way of the flow meter 29, pipe 28, hose 27, closing-opening valve 35, bellow-tube 34, and fueling nozzle 26. Here, the bellow-tube 34 is extended by the fuel pressure transported therethrough and the fueling nozzle 26 is inserted deeply into the fueling port 56. Thus, the fuel is never scattered. The quantity of fuel measured by the flow meter 29 is shown on the display 41 and the display part 45.

As the fueling is carried out, the full-tank fueling unit 51 begins to function (FIG. 9, ST7). When the set amount of fuel is discharged, or the fuel tank is filled to the maximum level (FIG. 9, ST8), the fuel control unit 50 closes the opening-closing valve 35 and stops the pump 30 (FIG. 9, ST9) to suspend the fueling. The fueling data is output to the data input/output unit 13 (FIG. 9, ST10). Then, the mechanism control unit 53 causes to drive the extending-shortening unit 32, the vertical moving unit 24, and the horizontal moving unit 21 (FIG. 9, ST11) to bring back the nozzle mechanism 25 to the initial position (FIG. 9, ST12), and the completion of the fueling operation is notified by the communicator 42 (FIG. 9, ST13).

Meanwhile, the data input/output unit 13, which has received the fueling data from the fueling machine 13 at ST10 of FIG. 9 (FIG. 8, ST11), plays a role to clear off the fueling fee (FIG. 8, ST12) with a customer's card. After the liquidation, the car stopper 19 is depressed which makes the car possible to leave the gas station. Then, the entrance judge lamp 17 lights in blue to notify other cars the possibility to get into the fueling area (FIG. 8, ST14).

In the case where the sorts of fuel in a fuel tank of a car and of the required fueling data are not identical at ST5 of FIG. 9 (FIG. 9, ST14), the communicator is caused to function for a certain period (FIG. 9, ST15), and then ST7 of FIG. 8 is carried out again by selecting a correct fuel sort to be dispensed via the keyboard 46.

As is obvious from the above description, all the steps of the fueling operation including the insertion of a fueling nozzle to a fueling port of an automobile, and the suspension of fueling at a required fueling level are carried out without a manual fueling operation, whereby it is possible to perform a fueling operation in a safe, convenient and economical manner without the provision of a fueling operator.

What is claimed is:

1. An automatic fueling system comprising:

a fueling machine comprising a nozzle mechanism comprising an injection pipe having a nozzle insertion sensor thereon, and a plurality of fueling nozzles contained in said injection pipe, each for dispensing a predetermined sort of fuel, and a fuel port sensor; and a data input/output unit for performing a signal transmission to and from said fueling machine;

wherein the insertion of one of said nozzles is carried out to an automobile to be fueled having a signal generator thereon by the movement of said fueling machine based on the signal transmission between said fuel port sensor and said signal generator, and the fueling is suspended by the detection of a required level of fueling;

wherein said fueling machine further comprises a fuel control unit comprising a fuel-sort discrimination unit and a full-tank fueling unit, said fuel control unit causes to function said fuel sort discrimination unit by the receipt of a nozzle-insertion signal from said nozzle-insertion sensor, and causes to function said full-tank fueling unit to start fueling when said fuel sort discrimination unit detects a correct fuel selection, and the fueling is suspended by the detection of a required level of fueling by said full-tank fueling unit.

2. The automatic fueling system as claimed in claim 1, wherein said data input/output machine comprises a mobile data input part.

3. The automatic fueling system as claimed in claim 2, wherein one of said nozzles for dispensing a desired sort of fuel is selected by inputting data from said mobile data input part, and said nozzle is injected from said injection pipe for performing fueling.

4. An automatic fueling system comprising:

a first fueling machine and a second fueling machine, each comprising a fuel control unit comprising a fuel-sort discrimination unit, a full-tank fueling unit, an injection pipe having a nozzle-insertion sensor thereon, and a plurality of fueling nozzles contained in said injection pipe, each for dispensing a predetermined sort of fuel, and a fuel port sensor; and a first data input/output unit and a second data input/output unit for performing a signal transmission respectively to and from said first fueling machine and said second fueling machine;

wherein said first fueling machine performs the insertion of one of said nozzles thereof to an automobile to be fueled having a signal generator thereon by the movement of said fueling machine based on the signal transmission between said fuel port sensor and said signal generator, said fuel control unit causes to function said fuel sort discrimination unit by the receipt of a nozzle-insertion signal from said nozzle-insertion sensor, and causes to function said full-tank fueling unit to start fueling when said fuel sort discrimination unit detects a correct fuel selection, the fueling is suspended by the detection of a required level of fueling by said full-tank fueling unit, and said first data input/output unit inhibits an input from said second data input/output unit by outputting a data input/output inhibition signal to said second data input/output unit when a fueling data is input to said first data input/output unit.

5. The automatic fueling system as claimed in claim 4, wherein said first fueling machine transmits a fueling inhibition signal to said second fueling machine by way of said first data input/output unit and said second data input/output unit when said first fueling machine detects the signal generator.

6. The automatic fueling system as claimed in claim 4, wherein said first fueling machine and said second fueling machine are provided to face each other with such a distance that only a single car passes between said first fueling machine and said second fueling machine.

* * * * *